US007146946B2

(12) United States Patent
Yudate et al.

(10) Patent No.: US 7,146,946 B2
(45) Date of Patent: Dec. 12, 2006

(54) VALVE TIMING ADJUSTING DEVICE

(75) Inventors: Koji Yudate, Tokyo (JP); Hiroyuki Kinugawa, Tokyo (JP); Akira Sakata, Tokyo (JP); Makoto Yamauchi, Tokyo (JP)

(73) Assignee: Mitsubishiki Denki Kabushiki Kaisha, Tokyo (JP)

( * ) Notice: Subject to any disclaimer, the term of this patent is extended or adjusted under 35 U.S.C. 154(b) by 37 days.

(21) Appl. No.: 10/992,775

(22) Filed: Nov. 22, 2004

(65) Prior Publication Data

US 2005/0109300 A1 May 26, 2005

(30) Foreign Application Priority Data

Nov. 21, 2003 (JP) ..... 2003-392524

(51) Int. Cl.
*F01L 1/34* (2006.01)

(52) U.S. Cl. ..... 123/90.17; 123/90.16; 123/90.15; 123/90.31; 92/132; 267/73; 267/74

(58) Field of Classification Search ..... 123/90.12, 123/90.15–90.17, 90.31; 74/568 R; 464/1, 464/2, 160; 92/121, 122
See application file for complete search history.

(56) References Cited

U.S. PATENT DOCUMENTS

| | | | | |
|---|---|---|---|---|
| 5,181,486 | A * | 1/1993 | Gyurovits | 123/90.17 |
| 5,967,104 | A * | 10/1999 | Nakayoshi et al. | 123/90.17 |
| 6,006,708 | A * | 12/1999 | Ken et al. | 123/90.17 |
| 6,035,819 | A * | 3/2000 | Nakayoshi et al. | 123/90.17 |
| 6,439,184 | B1 * | 8/2002 | Takenaka et al. | 123/90.17 |
| 6,443,113 | B1 * | 9/2002 | Kanada et al. | 123/90.17 |
| 6,450,138 | B1 * | 9/2002 | Kinugawa et al. | 123/90.17 |
| 6,619,248 | B1 * | 9/2003 | Bertelshofer et al. | 123/90.15 |
| 6,725,817 | B1 * | 4/2004 | Methley et al. | 123/90.17 |
| 6,805,081 | B1 * | 10/2004 | Watanabe et al. | 123/90.17 |

FOREIGN PATENT DOCUMENTS

| | | | |
|---|---|---|---|
| JP | 11-325309 | A | 11/1999 |
| JP | 2002-276312 | A | 9/2002 |
| JP | 2002-295210 | A | 10/2002 |

* cited by examiner

*Primary Examiner*—Thomas Denion
*Assistant Examiner*—Kyle M. Riddle
(74) *Attorney, Agent, or Firm*—Sughrue Mion, PIAC

(57) ABSTRACT

A valve timing adjusting device includes a first rotor that rotates synchronously with a crankshaft of an engine; a second rotor that is relatively rotatable by a predetermined angle within the first rotor, and is secured on the end face of an intake or an exhaust camshaft; and a tension spring that acts as an assisting spring for adjusting a relative position between both the rotors.

11 Claims, 11 Drawing Sheets

VALVE TIMING ADJUSTING DEVICE

BACKGROUND OF THE INVENTION

1. Field of the Invention

The present invention relates to a valve timing adjusting device that controls opening and closing timing of an intake valve or an exhaust valve of an internal combustion engine such as a motor engine (hereinafter referred to as an "engine").

2. Description of the Related Art

A conventional valve timing adjusting device is generally composed of a first rotor that is connected to a crankshaft of an engine by a rotational-driving force-transmitting member such as a chain, and that rotates synchronously with the crankshaft; a second rotor that is relatively rotatably by a predetermined angle provided within the first rotor, and is integrally secured on the end face of an intake camshaft or an exhaust camshaft of the engine; and a plurality of oil-pressure chambers partitioned between the second rotor and the above first rotor. The device is arranged such that hydraulic pressure of an oil pump, which takes a charge of supplying oil to a sliding portion of the engine, is applied to and exhausted from these oil-pressure chambers, and that the hydraulic pressure controls a relative position of the second rotor with respect to the first rotor.

In such valve timing adjusting devices, there are some valve timing adjusting devices equipped with a locking mechanism that restricts a relative rotation between the first rotor and the second rotor at the initial position in order to prevent the first rotor and the second rotor from accidentally contacting with each other and from thereby producing abnormal noises at the time of an engine start where oil-pressure is still low. This locking mechanism is generally composed of a lock hole formed in the one rotor and a lock pin provided engageably in the other rotor within the lock hole. In addition, there are some valve adjusting devices disclosed in JP 2002-295210 A and JP 2002-276312 A which includes an assisting spring placed in the oil-pressure chamber for urging, e.g., the second rotor to the advanced side of the first rotor rotates in the direction of rotation even when hydraulic pressure in the oil-pressure chamber is low, out of necessity of quickly rotating and returning the second rotor to the initial position with respect to the first rotor. As the conventional assisting spring, a compression spring is used. For example, JP 11-325309 A discloses an assisting spring of this kind.

However, when the second rotor is relatively rotates with respect to the first rotor (e.g., to the lagged side), seats of both the ends of the compression spring are restrained from being maintained in parallel at the time of expansion of the spring. For this reason, the compression spring is bent, and the spring may come in contact with an inner peripheral surface, with the result that the spring may not acquit its function as the assisting spring. Further, when the valve timing adjusting device with such a compression spring has a wide rotation angle, the spring is liable to bent. Therefore, it is difficult to set a wider rotation angle. As a remedy for conquering this difficulty, it is imaginable providing a mechanism for guiding the compression spring in a straight line to prevent the compression spring from being excessively bent. However, the guiding mechanism is effective only for hindering the compression spring from being excessively bent, the mechanism forces the compression spring to be maintained in a straight line. Therefore, the mechanism inherently involves incommodities that the compression spring strains a large load, and the spring suffers from reduced durability.

SUMMARY OF THE INVENTION

The present invention has been made to solve the aforementioned drawbacks of the conventional valve timing adjusting devices equipped with the compression spring acting as the assisting spring. An object of the invention is to provide a valve timing adjusting device in which its assisting spring is prevented from being excessively bent without burdening a heavy load thereon, and the device ensures a straight expansion of the assisting spring corresponding to an angular change even when the device is set to a large rotation angle.

The valve timing adjusting device according to the present invention includes a first rotor that rotates synchronously with a crankshaft of an internal combustion engine; a second rotor that is relatively rotatable by a predetermined angle within the first rotor, and is integrally secured on the end face of an intake camshaft or an exhaust camshaft of the internal combustion engine; and an assisting spring that adjusts a relative position between the second rotor and the first rotor; wherein the assisting spring is a tension spring.

Therefore, according to the present invention of the valve timing adjusting device, it prevents the tension spring from being excessively bent, and ensures a straight expansion corresponding to an angular change even when the device is set to a large rotation angle. Further, according to the present invention, it lightens a load imposed on the tension spring at the time of expansion of the spring, thereby improving the durability of the spring.

DETAILED DESCRIPTION OF THE PREFERRED EMBODIMENTS

Preferred embodiments of the present invention will now be described with reference to the accompanying drawings.

First Embodiment

Figure 1:
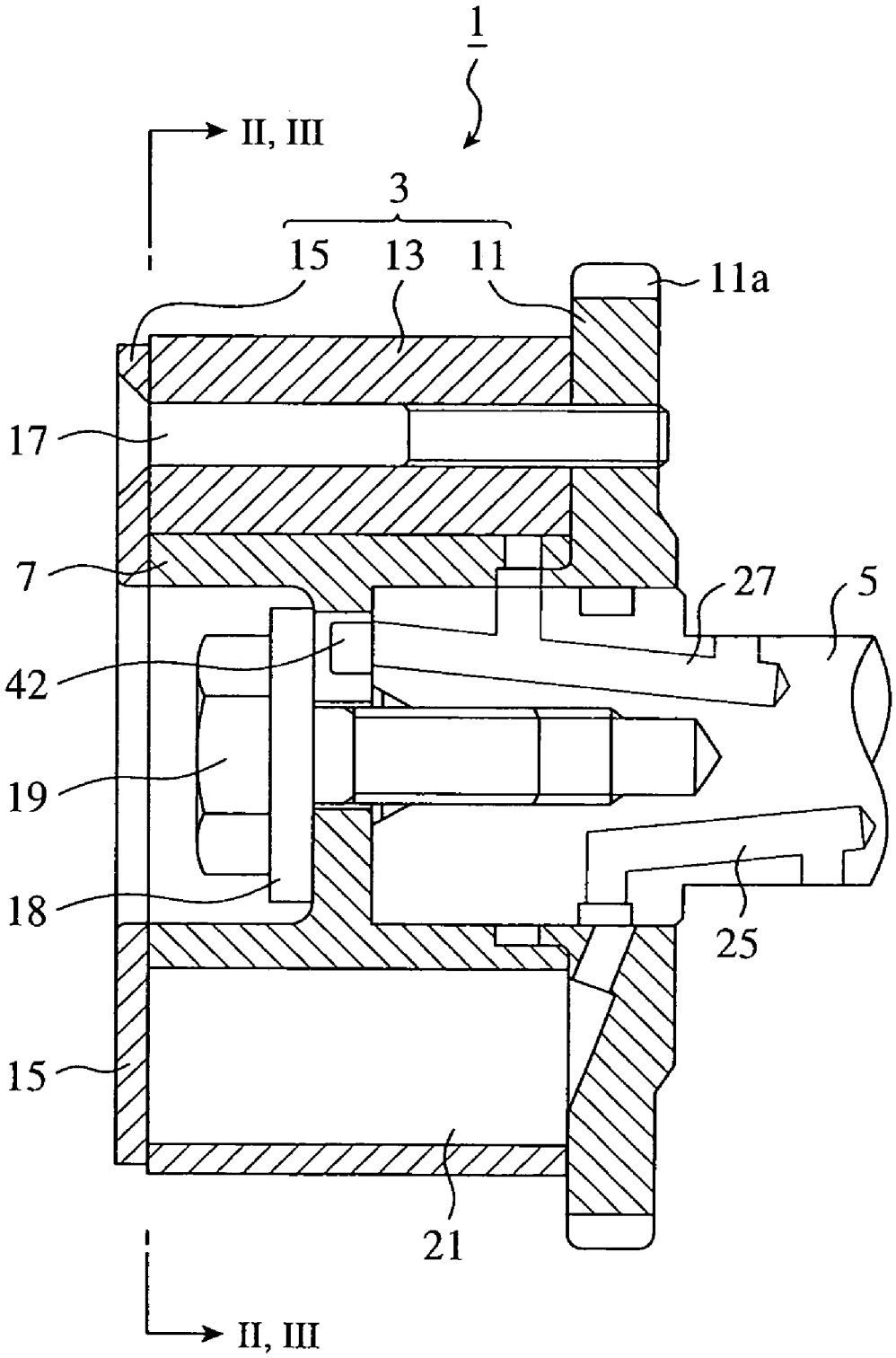
FIG. 1 is an axial sectional view showing an internal structure of a valve timing adjusting device according to a first embodiment of the present invention.
Figure 2:
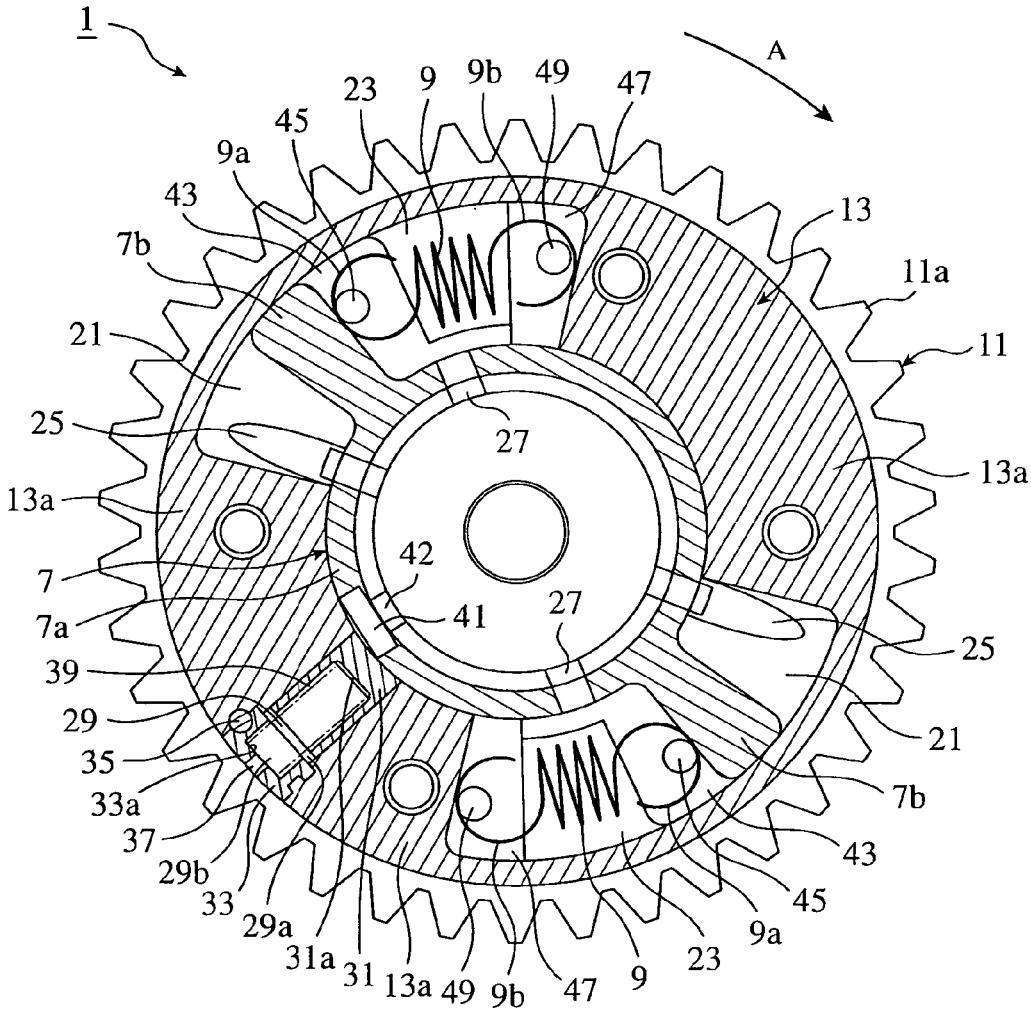
FIG. 2 is a radial sectional view, taken along the line II—II of FIG. 1, showing the state where a second rotor is at the most advanced position with respect to a first rotor.
Figure 3:
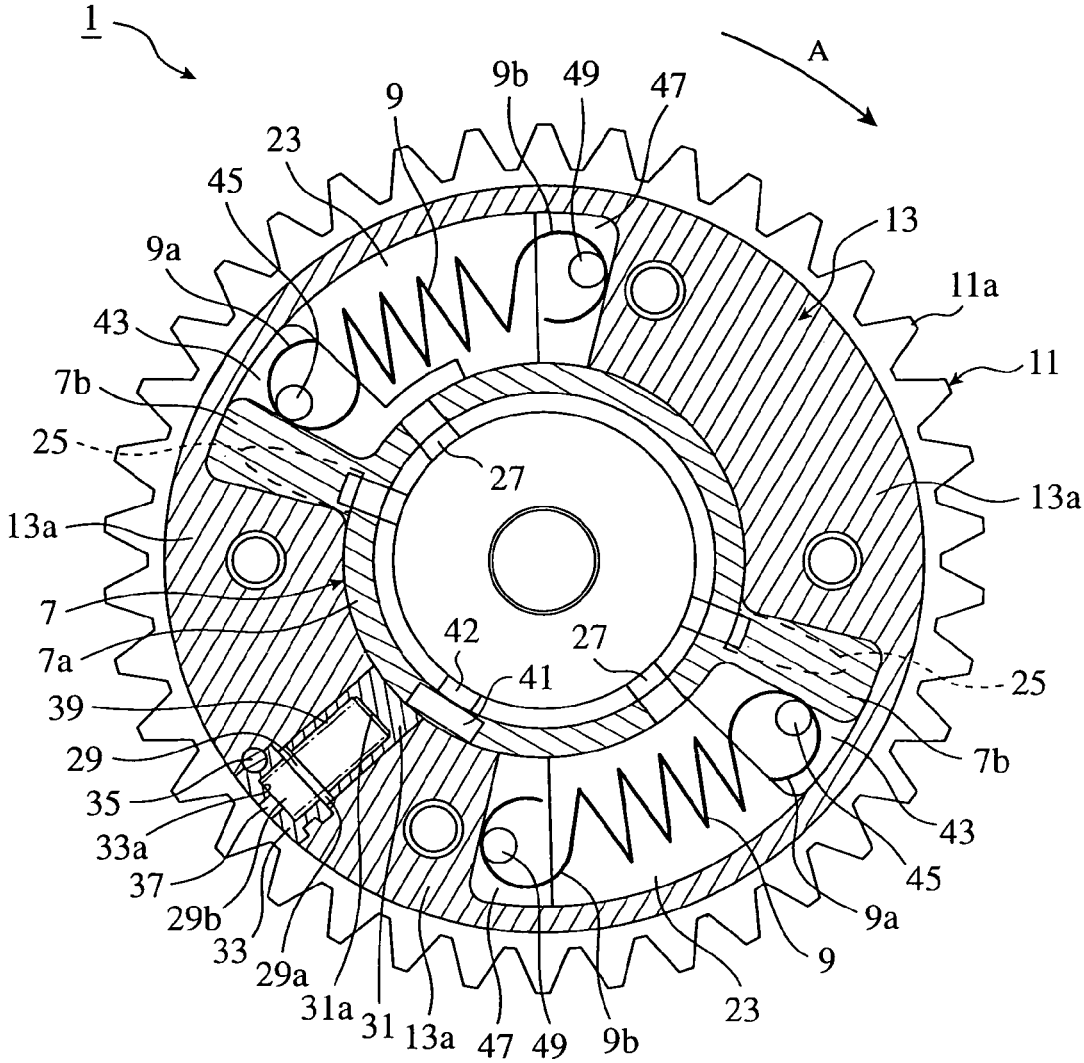
FIG. 3 is a radial sectional view showing, taken along the line III—III of FIG. 1, the state where the second rotor is at the most lagged position with respect to the first rotor.
Figure 4:
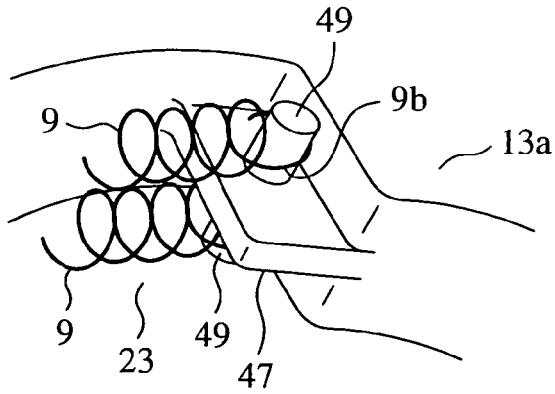
FIG. 4 is an enlarged perspective view of essential parts of FIG. 2 and FIG. 3.

FIG. 1 is an axial sectional view showing an internal structure of a valve timing adjusting device according to the first embodiment of the present invention. FIG. 2 is a radial sectional view, taken along the line II—II of FIG. 1, showing the state where a second rotor is at the most advanced position with respect to a first rotor. FIG. 3 is a radial sectional view, taken along the line III—III of FIG. 1, showing the state where the second rotor is at the most lagged position with respect to the first rotor. FIG. 4 is an enlarged perspective view showing essential parts of FIG. 2 and FIG. 3. It should be understood that the expression "axially" as used herein means "axially to the valve timing adjusting device", and the expression "radially" means "radially to the same device."

As shown in FIG. 1 to FIG. 3, a valve timing adjusting device 1 according to the first embodiment is generally composed of a first rotor 3 that rotates synchronously with a crankshaft (not shown) of an engine (not shown) through a chain (not shown); a second rotor 7 that is provided in the first rotor 3, and is integrally secured on the end face of an intake or an exhaust camshaft 5 (hereinafter referred to as simply a camshaft); and a tension spring (assisting spring) 9 that adjusts a relative rotation between the second rotor 7 and the first rotor 3.

The first rotor 3 is generally composed of a housing 11 that has outside a sprocket 11*a* for receiving a rotational driving force of the crankshaft (not shown), and has inside a bearing (not shown) slidingly contacting with the outer peripheral surface located in the vicinity of the end face of the camshaft 5; a case 13 that is arranged adjacently to the housing 11, and has a plurality of shoes 13*a* (two shoes in the first embodiment as shown in FIG. 2 and FIG. 3) projecting inwardly radially for forming a plurality of spaces; and a cover 15 that covers an internal space of the case 13. And these parts are integrally fastened to each other with a bolt 17.

The second rotor 7 is a rotor that has a boss 7*a* integrally fastened on the end face of the camshaft 5 that rotates in the direction indicated by the arrow A with a bolt 19 through a washer 18, and has a plurality of vanes 7*b* radially outwardly projecting from the periphery of the boss 7*a* (hereinafter the second rotor 7 is also referred to as a vane rotor 7). Each of the vanes 7*b* of the vane rotor 7 partition a plurality of internal spaces formed by the shoes 13*a* of the case 13 into an advanced-side oil-pressure chamber 21 to which hydraulic pressure is applied when the vane rotor 7 is relatively rotated to the advanced side with respect to the first rotor 3 and an lagged-side oil-pressure chamber 23 to which hydraulic pressure is applied when the vane rotor 7 is relatively rotated to the lagged side with respect to the first rotor 3. One end of a first oil passage 25 formed within the camshaft 5 is connected to each of the advanced-side oil-pressure chambers 21, and one end of a second oil passage 27 similarly formed within the camshaft 5 is connected with each of the lagged-side oil-pressure chambers 23. Each of the other ends of the first oil passage 25 and the second oil passage 27 extends to an oil pump (not shown) and an oil pan (not shown) through an oil control valve (not shown, and hereinafter referred to as an OCV).

A receiving hole 29 passing through the shoe radially to the device is formed in one shoe 13*a* of the case 13 of the valve timing adjusting device 1. The receiving hole 29 is generally composed of a small portion 29*a* located inside radially to the device and a large portion 29*b* located more outside radially to the device than the small portion 29*a*. In the small portion 29*a* of the receiving hole 29, a substantially cylindrical lock pin 31 is reciprocally provided axially thereto. In the bottom of the lock pin 31 located outside radially to the device, a bottomed hole 31*a* is formed. Moreover, a stopper 33 is press-fitted from outside radially into the large portion 29*b* of the receiving hole 29, and is fixed therein by a shaft 35. The stopper 33 has inside a bottomed hole 33*a* radially, and in the bottom of the bottomed hole 33*a* is provided a back-pressure exhausting hole 37, passing through the receiving hole axially and located behind the lock pin 31, which communicates a space formed in the receiving hole 29 with the atmosphere. Between the bottomed hole 31*a* of the lock pin 31 and the bottomed hole 33*a* of the stopper 33 is provided a coil spring 39 that continuously inwardly urges radially the lock pin 31.

Meanwhile, in the periphery of the boss 7*a* of the vane rotor 7 is formed an engaging hole 41 in which the lock pin 31 engages by radially inwardly advancing it by the aid of an urging force of the coil spring 39 when a relative position of the vane rotor 7 with respect to the case 13 is located between the most advanced position and the most lagged position (intermediate position) (intermediate lock). In addition, an unlocking oil passage 42 is provided between the engaging hole 41 and the second oil passage 27.

Moreover, as shown in FIG. 2 and FIG. 3, along the vane 7*b* of the vane rotor 7, which forms one sidewall of each of the lagged-side oil-pressure chambers 23, is provided with a partition wall (partition) 43 on the vane side to axially partition part of the lagged-side oil-pressure chamber 23. On the partition wall 43 is protrusively provided a pin 45 on the vane side which passes through the wall in the direction of the thickness thereof. In like manner, as shown in FIG. 2 to FIG. 4, along the shoe 13*a* of the case 13, which forms the other sidewall of each of the lagged-side oil-pressure chambers 23, is provided a partition wall (partition) 47 on the shoed side to axially partition part of the lagged-side oil-pressure chamber 23. On the partition wall 47 is protrusively provided a pin 49 on the shoe side which passes through the wall in the direction of the thickness thereof. Between the pin 45 on the vane side projecting from both sides of the partition wall 43 on the vane side and the pin 49 on the shoe side projecting from both sides of the partition wall 47 on the shoe side, two tension springs 9 are provided in a parallel relationship. Both ends 9*a* and 9*b* of the tension spring 9 are formed in the shape of a hook. The hook-shaped end 9*a* is held rotatably around the pin 45 on the vane side, and the hook-shaped end 9*b* is held rotatably around the pin 49 on the shoe side. It is arranged such that the diameters of the hook-shaped ends 9*a* and 9*b* of the tension spring 9 are larger than those of the pin 45 on the vane side and the pin 49 on the shoe side, respectively. The partition wall 43 on the vane side and the partition wall 47 on the shoe side have a function of preventing the two tension springs 9 from interfering each other at the time of expansion of the spring.

The outermost periphery of the vane 7*b* of the vane rotor 7 and the innermost periphery of the shoe 13*a* of the case 13 have a microclearance for blocking a flow of oil between the advanced-side oil-pressure chamber 21 and the lagged-side oil-pressure chamber. Instead, a seal (not shown) may be provided therebetween to deal with the flow of oil (this goes for the second and third embodiments described later).

The operation of the first embodiment will now be described below.

First of all, when the engine is stopped or immediately after engine is started, oil remaining in the advanced-side oil-pressure chamber 21 and the lagged-side oil-pressure chamber 23 of the valve timing adjusting device 1 is returned to the oil pan (not shown) via the first oil passage 25, the second oil passage 27, and the OCV (not shown). Thus, the lock pin 31 engages the engaging hole 41 by an urging force of the coil spring 39, and a relative rotation between the first rotor 3 and the second rotor 7 is restricted at an intermediate position located between the most advanced position and the most lagged position (locking state).

Then, when the oil pump (not shown) is driven by starting the engine, oil is supplied from the oil pan (not shown) to the lagged-side oil-pressure chamber 23 of the valve timing adjusting device 1 via the OCV (not shown) and the second oil passage 27. When the lagged-side oil pressure acted on the tip of the lock pin 31 from the second oil passage 27 via the unlocking oil passage 42, the lock pin 31 is thrust back against an urging force of the coil spring 39 and pulled out of the engaging hole 41. At that time, the first rotor 3 and the second rotor 7 come into the state where the two rotors are relatively rotatable (unlocking state).

The first rotor 3 and the second rotor 7 in the unlocking state are permitted to relatively rotate to the advanced side or the lagged side by a predetermined rotation angle by the advanced-side oil pressure applied to the advanced-side oil-pressure chamber 21 and the lagged-side oil pressure applied to the lagged-side oil-pressure chamber 23 at that time.

In the unlocking state, as shown in FIG. 2, to move a relative position of the second rotor 7 with respect to the first rotor 3 to the advanced side or the most advanced position, it has only to rotate the second rotor 7 in the direction indicated by the arrow A by the advanced-side oil pressure and an urging force (return force to the stationary state) of the tension spring 9 serving as the assisting spring in addition to the oil pressure. At that time, the hook-shaped ends 9*a* and 9*b* of the tension spring 9 are rotated around the pin 45 on the vane side and the pin 49 on the shoe side, and are outwardly forwarded. Consequently, the tension spring 9 is immune to the occurrence of bending at the time of contraction, and the spring is maintained in a straight line.

Similarly, in the unlocking state, as shown in FIG. 3, to move a relative position of the second rotor 7 with respect to the first rotor 3 to the lagged side or the most lagged position, it has only to rotate the second rotor 7 in the opposite direction relative to the direction indicated by the arrow A by the lagged-side oil pressure against an urging force (return force to the stationary state) of the tension spring 9. At that time, the hook-shaped ends 9*a* and 9*b* of the tension spring 9 are rotated around the pin 45 on the vane side and the pin 49 on the shoe side, and are inwardly returned. Accordingly, the tension spring 9 is expanded uniformly in any part at the time of expansion, thereby maintaining the spring in a straight line without being slacked.

Further, the two tension springs 9 disposed in a parallel relationship are securely prevented from coming into a state of interfering each other by the partition wall 43 on the vane side or the partition wall 47 on the shoe side located between the springs. This does make possible to nip prospective malfunction of the whole valve timing adjusting device 1 in the bud, which might be occurred due to an accidental mutual interference between the tension springs 9.

As mentioned above, through the structure according to the first embodiment in which the valve timing adjusting device is arranged to include the first rotor 3 that rotates synchronously with the crankshaft (not shown) of the engine (not shown); the second rotor 7 that is relatively rotatable by a predetermined angle within the first rotor 3, and integrally secured on the end face of the camshaft 5 of the engine (not shown); and a tension spring 9 that adjusts a relative position between the second rotor 7 and the first rotor 3, it prevents the tension spring 9 from being excessively bent, and ensures that the tension spring 9 straightly expands and contracts correspondingly to an angular change even when the device is set to a wide rotation angle. Also, according to the first embodiment, it lightens a load imposed on the tension spring 9 at the time of expansion, which enhances the durability of the tension spring 9.

Further, through the structure according to the first embodiment in which it is arranged that the hook-shaped ends 9*a* and 9*b* of the tension spring 9 are rotatably maintained, respectively thereby maintaining the tension spring 9 in a straight line, and securely lightning a load imposed on the tension spring 9 attended with expansion thereof. Also, according to the first embodiment, since it lightens a load imposed on the tension spring 9 with a simple arrangement, the cost to be incurred for manufacturing the device can be held down.

Moreover, through the structure according to the first embodiment in which it is arranged that the diameters of the hook-shaped ends 9*a* and 9*b* of the tension spring 9 are larger than those of the pins 45 and 49, respectively, the hook-shaped ends 9*a* and 9*b* rotate largely along around the pins 45 and 49, respectively, thereby rapidly rotating the hook-shaped ends 9*a* and 9*b* therearound without being subjected to large friction from the outer surfaces of the pins 45 and 49, respectively. This maintains the tension spring 9 in a straight line, and securely lightens a load imposed on the tension spring 9.

Furthermore, through the structure according to the first embodiment in which it is arranged that two tension springs 9 are provided in the lagged-side oil-pressure chambers 23 partitioned between the first rotor 3 and the second rotor 7, it enables a secure and quick relative rotation of the second rotor 7 with respect to the first rotor 3 by the aid of an urging force of the two tension springs 9. Also, a load (assist torque) on a per-spring basis can be reduced. It should be appreciated that while in the first embodiment, two tension springs 9 are provided in the lagged-side oil-pressure chamber 23, the number of the tension spring 9 may be one, or three or more. Although in the first embodiment, the tension spring 9 is provided in the lagged-side oil-pressure chamber 23, according to circumstances, the tension spring 9 may be provided in the advanced-side oil-pressure chamber 21.

In addition, through the structure according to the first embodiment in which it is arranged that the partition walls 43 and 47 are provided between the two tension springs 9, it securely prevents the two tension springs 9 from coming in contact with and interfering each other when the springs expand. This maintains each of the tension springs 9 in a straight line, thereby clipping prospective malfunction of the valve timing adjusting device 1 in the bud.

It should be appreciated that while in the first embodiment, the valve timing adjusting device is arranged such that the relative rotation restricting position (initial position) between the first rotor 3 and the second rotor 7 is set to the intermediate position, the initial position may be set to the most advanced position or to the most lagged position. Likewise, when the tension spring 9 is provided in the advanced-side oil-pressure chamber 21, it may also be arranged that the initial position is set to the most advanced position or to the most lagged position.

Additionally, while in the first embodiment it is arranged that the hook-shaped ends 9*a* and 9*b* of the tension spring 9 are each provided rotatably around the external peripheral surfaces of the pins 45 and 49, it may be arranged that a concave extending circumferentially along the periphery of the pins 45 and 49 is formed around the outer peripheral surface of the pins, and the hook-shaped ends 9*a* and 9*b* are placed within the concave. In this case, owing to the advantage that the hook-shaped ends 9*a* and 9*b* are maintained rotatably within the concaves, the arrangement securely prevents the hook-shaped ends 9*a* and 9*b* from being accidentally pulled out of the pins 45 and 49, respectively at the time of expansion of the tension spring 9, thereby hindering the valve timing adjusting device 1 from falling into malfunction as the result of inadvertent incidents.

Besides, although in the first embodiment it is arranged that the vane rotor 7 is provided with two vanes 7*b*, and that the case 13 is provided with two shoes 13*a*, three or more vanes 7*b* and shoes 13*a* may be provided without being limited to this arrangement.

Second Embodiment

Figure 5:
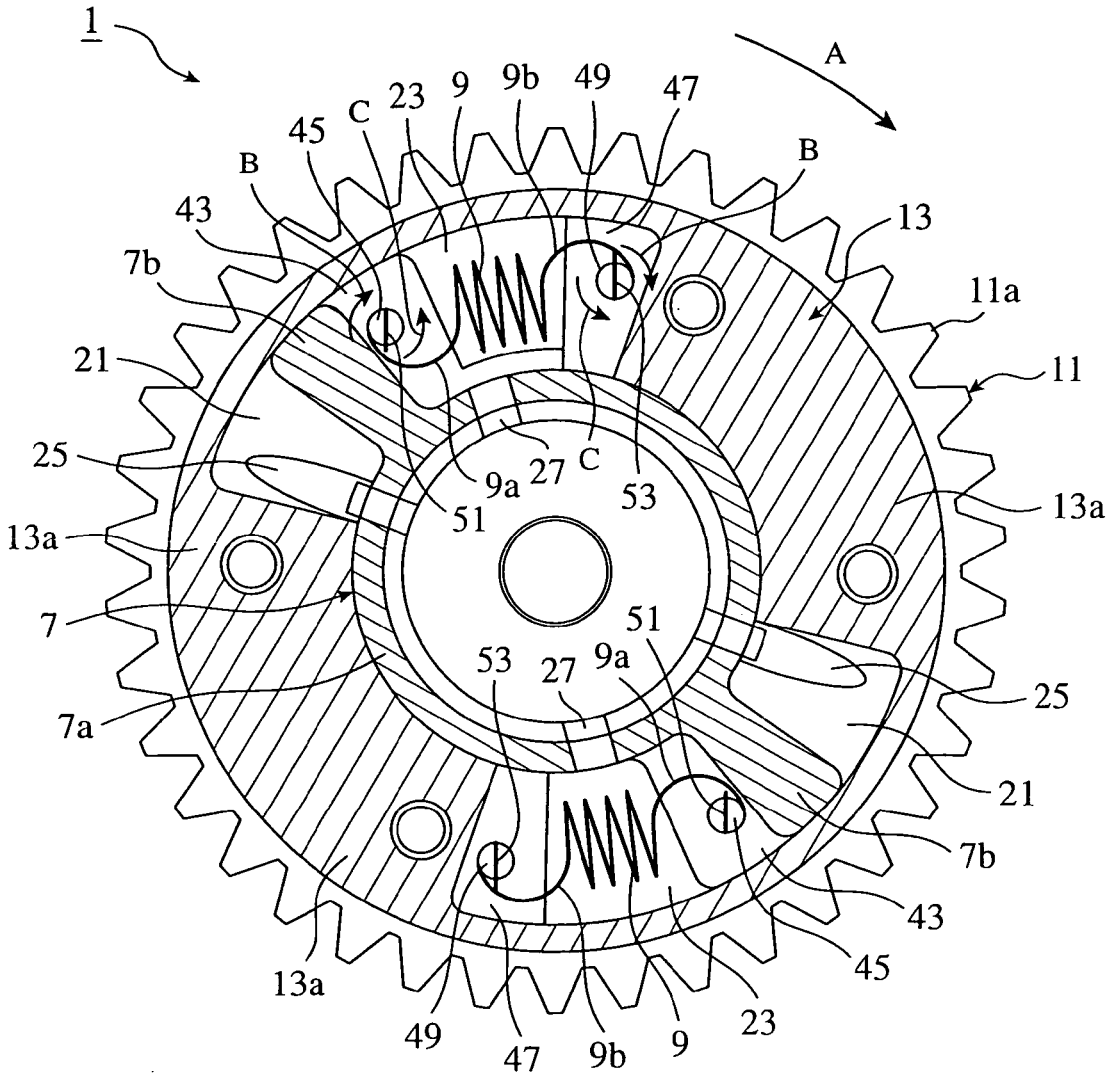
FIG. 5 is a radial sectional view showing an internal structure of a valve timing adjusting device according to a second embodiment of the present invention, where a second rotor is at the most advanced position with respect to a first rotor.
Figure 6:
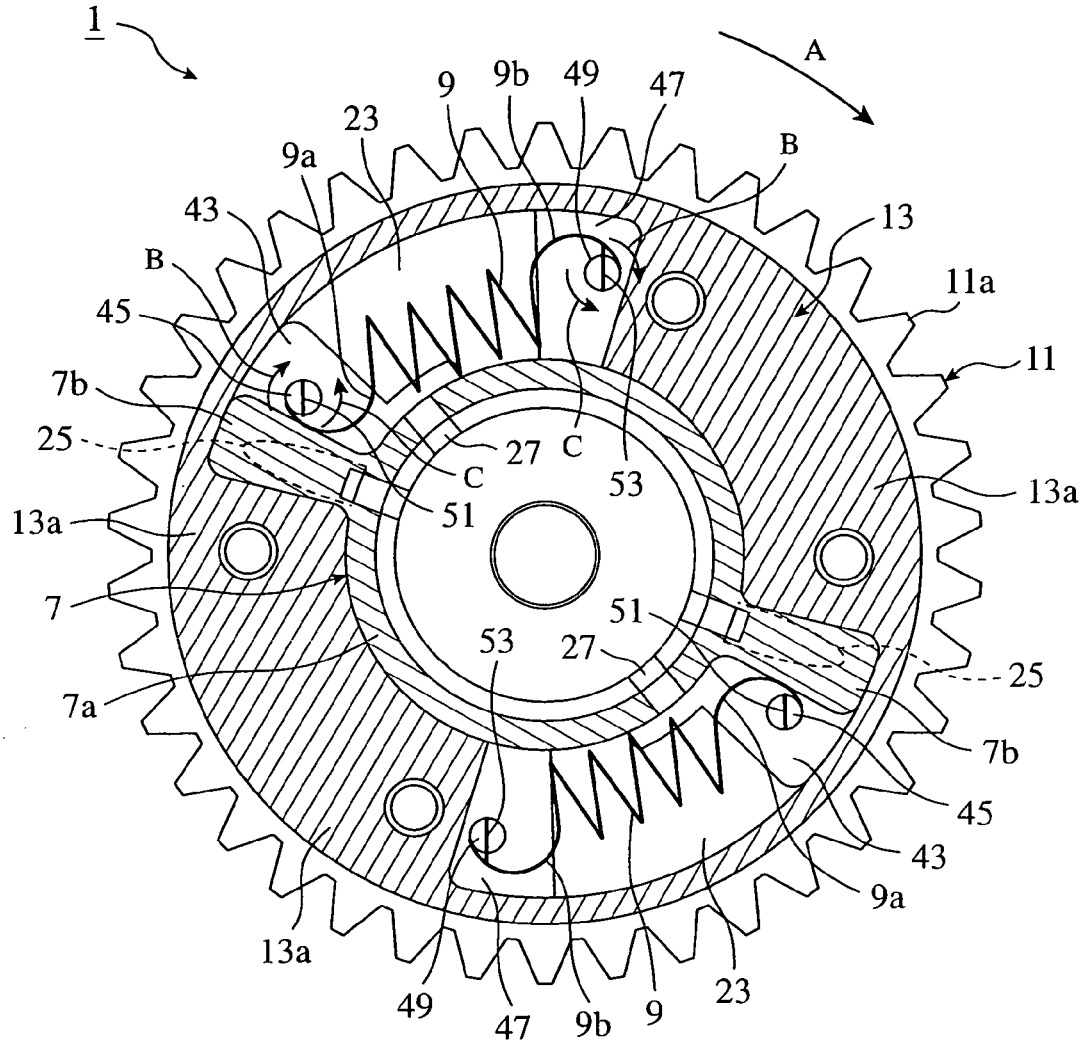
FIG. 6 is a radial sectional view showing the state where the second rotor is at the most lagged position with respect to the first rotor in the valve timing adjusting device shown in FIG. 5.
Figure 7:
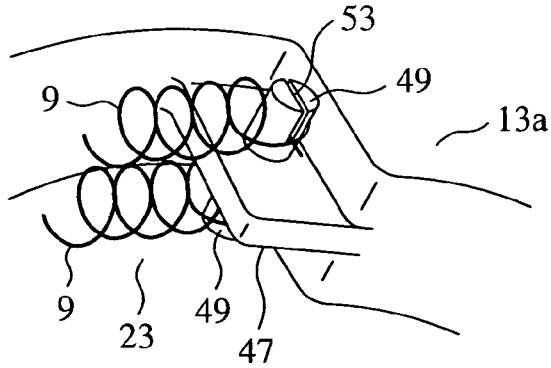
FIG. 7 is an enlarged perspective view showing essential parts of FIG. 5 and FIG. 6.

FIG. 5 is a radial sectional view showing an internal structure of a valve timing adjusting device according to the second embodiment of the present invention, where a second rotor is at the most advanced position with respect to the first rotor. FIG. 6 is a radial sectional view showing the state where the second rotor is at the most lagged position with respect to the first rotor in the valve timing adjusting device shown in FIG. 5. FIG. 7 is an enlarged perspective view showing essential parts of FIG. 5 and FIG. 6. Of the constituent elements in the second embodiment, like reference numerals as in the first embodiment designate like constituent elements, and thus explanations thereof are omitted for brevity's sake.

A feature of the second embodiment is in that the partition wall 43 of the vane rotor 7 in the first embodiment is rotatably provided with a pin 45, and the partition wall 47 of the case 13 is rotatably provided with a pin 49, as well as in that the hook-shaped ends 9*a* and 9*b* of the tension spring 9 are fixed on both the pins 45 and 49, respectively. On both the end faces of the pin 45 are formed a cut groove 51 formed by cutting the end face from the face axially to a predetermined depth. Similarly, on both the end faces of the pin 49 are formed a cut groove 53 formed by cutting the end face from the face axially to a predetermined depth. In the cut grooves 51 and 53, the hook-shaped ends 9*a* and 9*b* of the tension spring 9 are held therebetween, thereby enabling the hook-shaped ends 9*a* and 9*b* to rotate together with the pins 45 and 49, respectively.

The operation of the second embodiment will now be described below.

In the unlocking state, as shown in FIG. 5, to move a relative position of the second rotor 7 with respect to the first rotor 3 to the advanced side or the most advanced position, it has only to rotate the second rotor 7 in the direction indicated by the arrow A by the advanced-side oil pressure and an urging force (return force to the stationary state) of the tension spring 9 serving as the assisting spring in addition to the oil pressure. At that time, the hook-shaped ends 9*a* and 9*b* of the tension spring 9 are rotated in the direction indicated by the arrow B together with the pin 45 on the vane side and the pin 49 on the shoe side, respectively, and outwardly forwarded in such a situation that they are wound around the external surfaces of the respective pins. Thus, the tension spring 9 is immune to the occurrence of bending at the time of contraction, and the spring is maintained in a straight line.

Similarly, in the unlocking state, as shown in FIG. 6, to move a relative position of the second rotor 7 with respect to the first rotor 3 to the lagged side or the most lagged position, it has only to rotate the second rotor 7 in the opposite direction relative to the direction indicated by the arrow A by the lagged-side oil pressure against an urging force (return force to the stationary state) of the tension spring 9. At that time, the hook-shaped ends 9*a* and 9*b* of the tension spring 9 are rotated in the direction indicated by the arrow C (in the opposite direction relative to the direction indicated by the arrow B) together with the pin 45 on the vane side and the pin 49 on the shoe side, respectively and unwound from the external surfaces of the respective pins. Accordingly, the tension spring 9 is expanded uniformly in any part at the time of expansion, so that the spring is securely maintained in a straight line without being slacked.

Further, the two tension springs 9 disposed in a parallel relationship are securely prevented from falling into a state of interfering each other by the partition wall 43 on the vane side or the partition wall 47 on the shoe side located between the springs. This does make possible to clip prospective malfunction of the whole valve timing adjusting device 1 in the bud, which might be occurred due to an accidental mutual interference between the tension springs 9.

As mentioned above, through the structure according to the second embodiment in which it is arranged that the partition wall 43 of the vane rotor 7 and the partition wall 47 of the case 13 are rotatably provided with a pin 45 and a pin 49, respectively, and that on both the pins 45 and 49 the hook-shaped ends 9*a* and 9*b* of the tension spring 9 are fixed, respectively, it maintains the tension spring 9 in a straight line, and securely lightens a load imposed on the tension spring 9 attended with expansion of the spring. Also, according to the second embodiment, it reduces a load imposed on the tension spring 9 with a simple arrangement, thereby holding down the cost to be incurred for manufacturing the device.

It should be appreciated that while in the second embodiment, the valve timing adjusting device includes the locking mechanism similar to the locking mechanism composed of the receiving hole 29, lock pin 31, and engaging hole 41 discussed in the first embodiment; and the unlocking mechanism resemblant to the unlocking mechanism composed of the unlocking oil passage 42 discussed in the first embodiment, an illustration of the locking mechanism and unlocking mechanism in the second embodiment is omitted in FIG. 5 and FIG. 6. Instead, the valve timing adjusting device may include a locking mechanism and a unlocking mechanism different from those appeared in the first embodiment, respectively.

Third Embodiment

Figure 8:
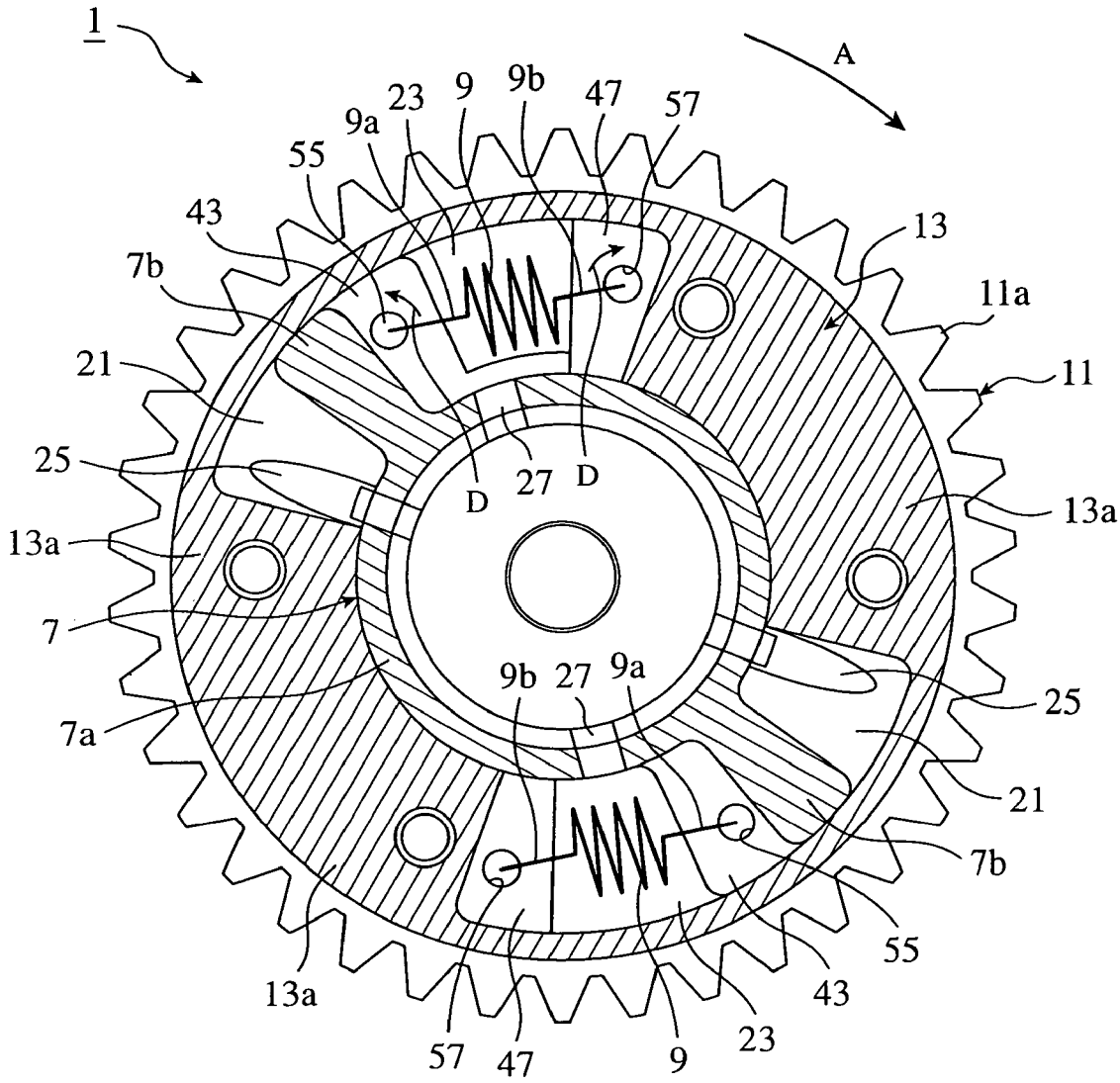
FIG. 8 is a radial sectional view showing an internal structure of a valve timing adjusting device according to a third embodiment of the present invention, where a second rotor is at the most advanced position with respect to a first rotor.
Figure 9:
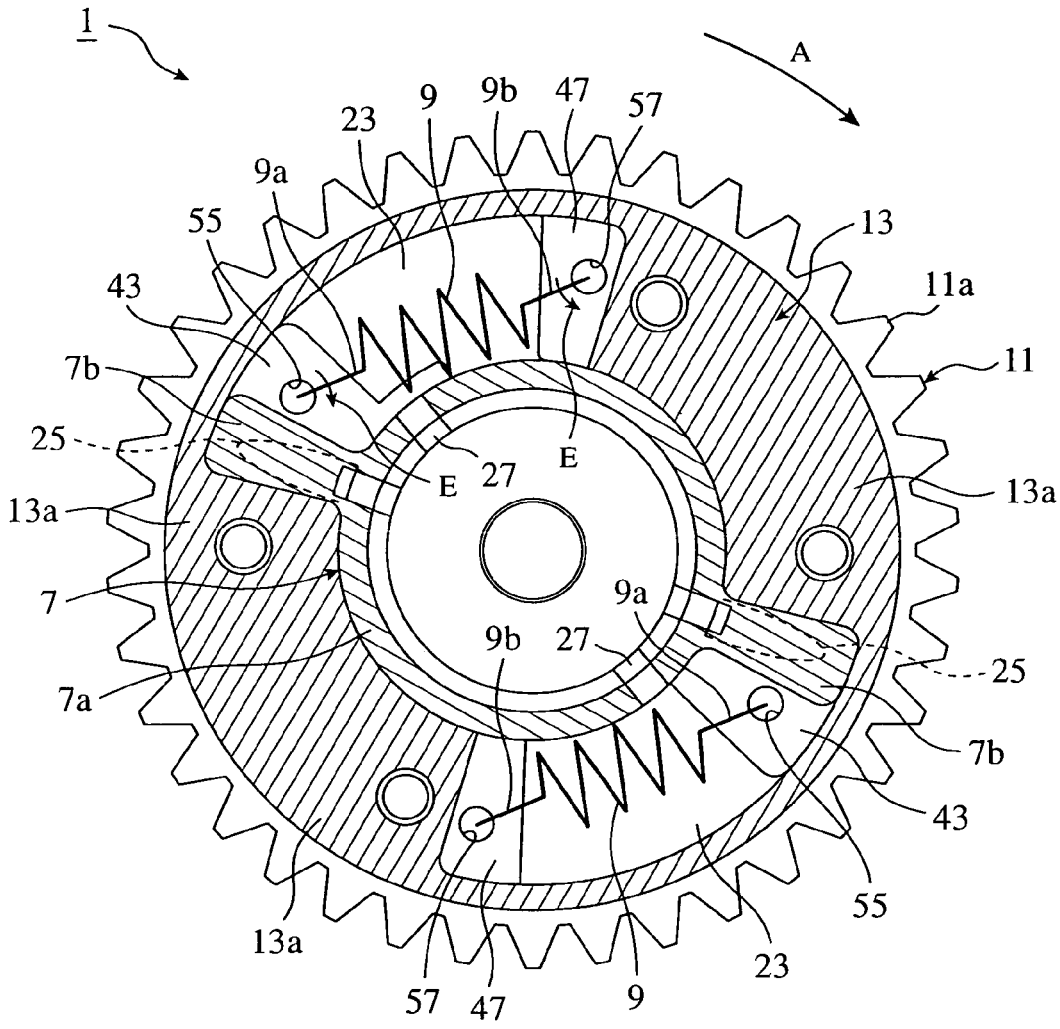
FIG. 9 is a radial sectional view showing the state where the second rotor is at the most lagged position with respect to the first rotor in the valve timing adjusting device shown in FIG. 8.
Figure 10:
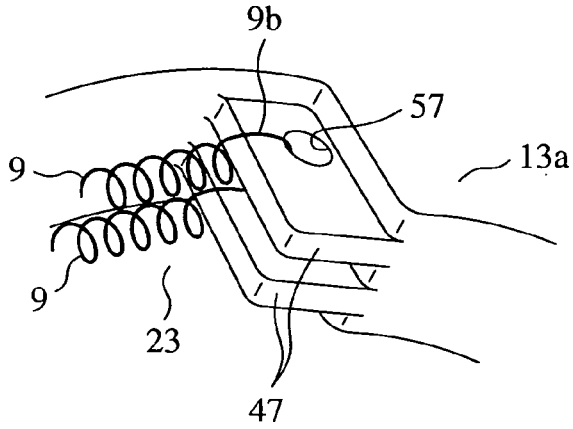
FIG. 10 is an enlarged perspective view showing essential parts of FIG. 8 and FIG. 9.

FIG. 8 is a radial sectional view showing an internal structure of a valve timing adjusting device according to the third embodiment of the present invention, where a second rotor is at the most advanced position with respect to a first rotor. FIG. 9 is a radial sectional view showing the state where the second rotor is at the most lagged position with respect to the first rotor in the valve timing adjusting device shown in FIG. 8. FIG. 10 is an enlarged perspective view showing essential parts of FIG. 8 and FIG. 9. Of the constituent elements in the third Embodiment, like reference numerals as in the first embodiment designate like constituent elements, and thus explanations thereof are omitted for brevity's sake.

A feature of the third embodiment is in that it is arranged that the vane rotor 7 is provided with two partition walls 43; each of which has a through hole (hole) 55 formed therein instead of the pin 45 in the first embodiment; and that the case 13 is provided with two partition walls 47; each of which has a through hole (hole) 57 formed therein instead of the pin 49 in the first embodiment; and the hook-shaped ends 9*a* and 9*b* of the tension spring 9 are passed through both the through holes 55 and 57, respectively to rotatably maintain the ends.

The operation of the third embodiment will now be described below.

In the unlocking state, as shown in FIG. 8, to move a relative position of the second rotor 7 with respect to the first rotor 3 to the advanced side or the most advanced position, it has only to rotate the second rotor 7 in the direction indicated by the arrow A by the advanced-side oil pressure and an urging force (return force to the stationary state) of the tension spring 9 acting as the assisting spring in addition to the oil pressure. At that time, the hook-shaped ends 9*a* and 9*b* of the tension spring 9 are rotated in the direction indicated by the arrow D around the through hole 55 on the vane side and the through hole 57 on the shoe side, respectively and outwardly forwarded. Therefore, the tension spring 9 is immune to the occurrence of bending at the time of contraction, and the spring is maintained in a straight line.

Similarly, in the unlocking state, as shown in FIG. 9, to move a relative position of the second rotor 7 with respect to the first rotor 3 to the lagged side or the most lagged position, it has only to rotate the second rotor in the opposite direction relative to the direction indicated by the arrow A by the lagged-side oil pressure against an urging force (return force to the stationary state) of the tension spring 9. At that time, the hook-shaped ends 9*a* and 9*b* of the tension spring 9 are rotated in the direction indicated by the arrow E (in the opposite direction relative to the direction indicated by the arrow D) around the through hole 55 on the vane side and the through hole 57 on the shoe side, respectively and inwardly forwarded. For this reason, the tension spring 9 is expanded uniformly in any part at the time of expansion, so that the spring is securely maintained in a straight line without being slacked.

In addition, the two tension springs 9 disposed in a parallel relationship are placed in the state in which the springs are separated from each other by a predetermined distance by the partition walls 43 and 47, respectively, which surely prevents the springs from falling into the state of mutual interference. This does make possible to clip prospective malfunction of the whole valve timing adjusting device 1 in the bud, which might be occurred due to an accidental mutual interference between the tension springs 9.

As mentioned above, through the structure according to the third embodiment in which the trough hole 55 is formed in the two partition walls 43; the through hole 57 is formed in the two partition walls 47; and the hook-shaped ends 9*a* and 9*b* of the tension spring 9 are passed through both the through holes 55 and 57, respectively to rotatably maintain the ends, it maintains the tension spring 9 in a straight line, and securely lightens a load imposed on the tension spring 9 attended with expansion of the spring. Additionally, according to the third embodiment, it reduces a load imposed on the tension spring with a simple arrangement, thereby preventing an increase of the cost to be incurred for manufacturing the device.

While in the third embodiment, the device includes the locking mechanism similar to the locking mechanism generally composed of the receiving hole 29, lock pin 31, and engaging hole 41 discussed in the first embodiment; and the unlocking mechanism resemblant to the unlocking mechanism generally composed of the unlocking oil passage 42, an illustration of the locking mechanism and unlocking mechanism are not shown in FIG. 8 and FIG. 9. Alternatively, the valve timing adjusting device may include a locking mechanism and a unlocking mechanism different from those discussed in the first embodiment, respectively.

Fourth Embodiment

Figure 11:
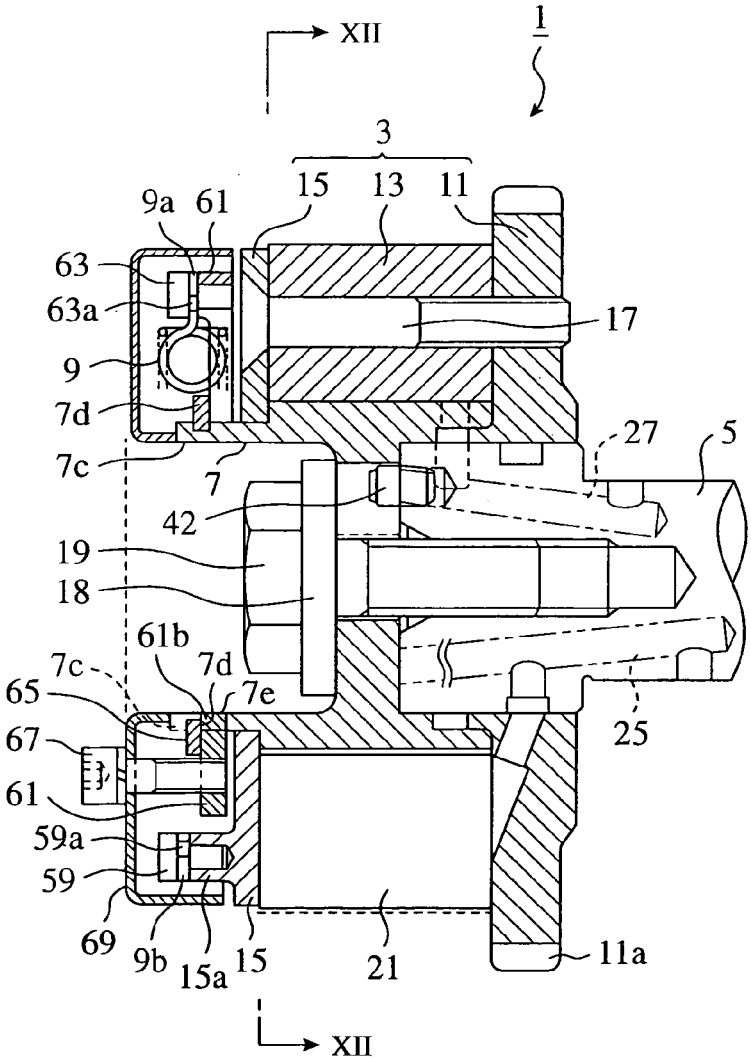
FIG. 11 is an axial sectional view showing an internal structure of a valve timing adjusting device according to a fourth embodiment of the present invention.
Figure 12:
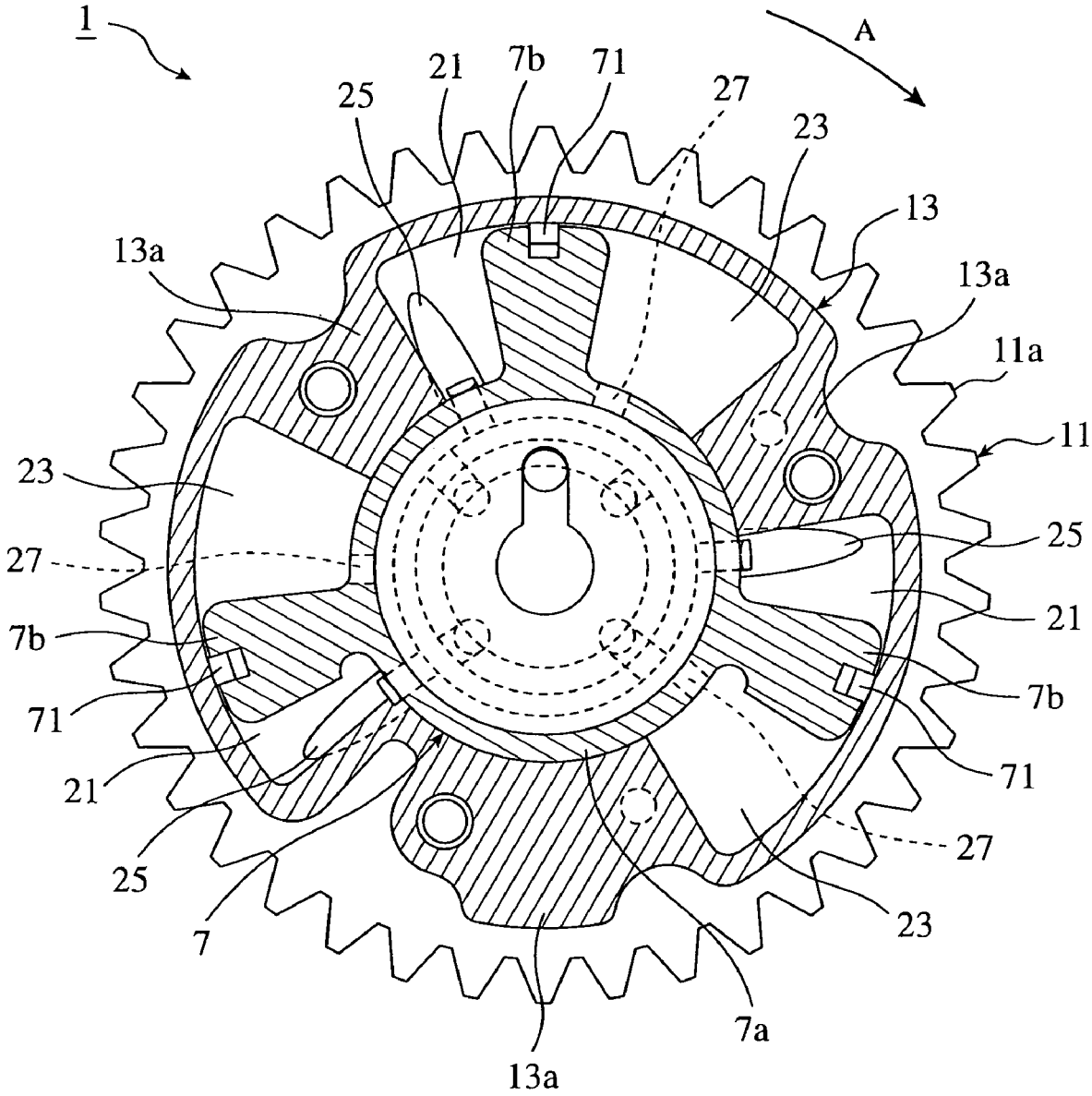
FIG. 12 is a radial sectional view taken along the line XII—XII of FIG. 11.
Figure 13:
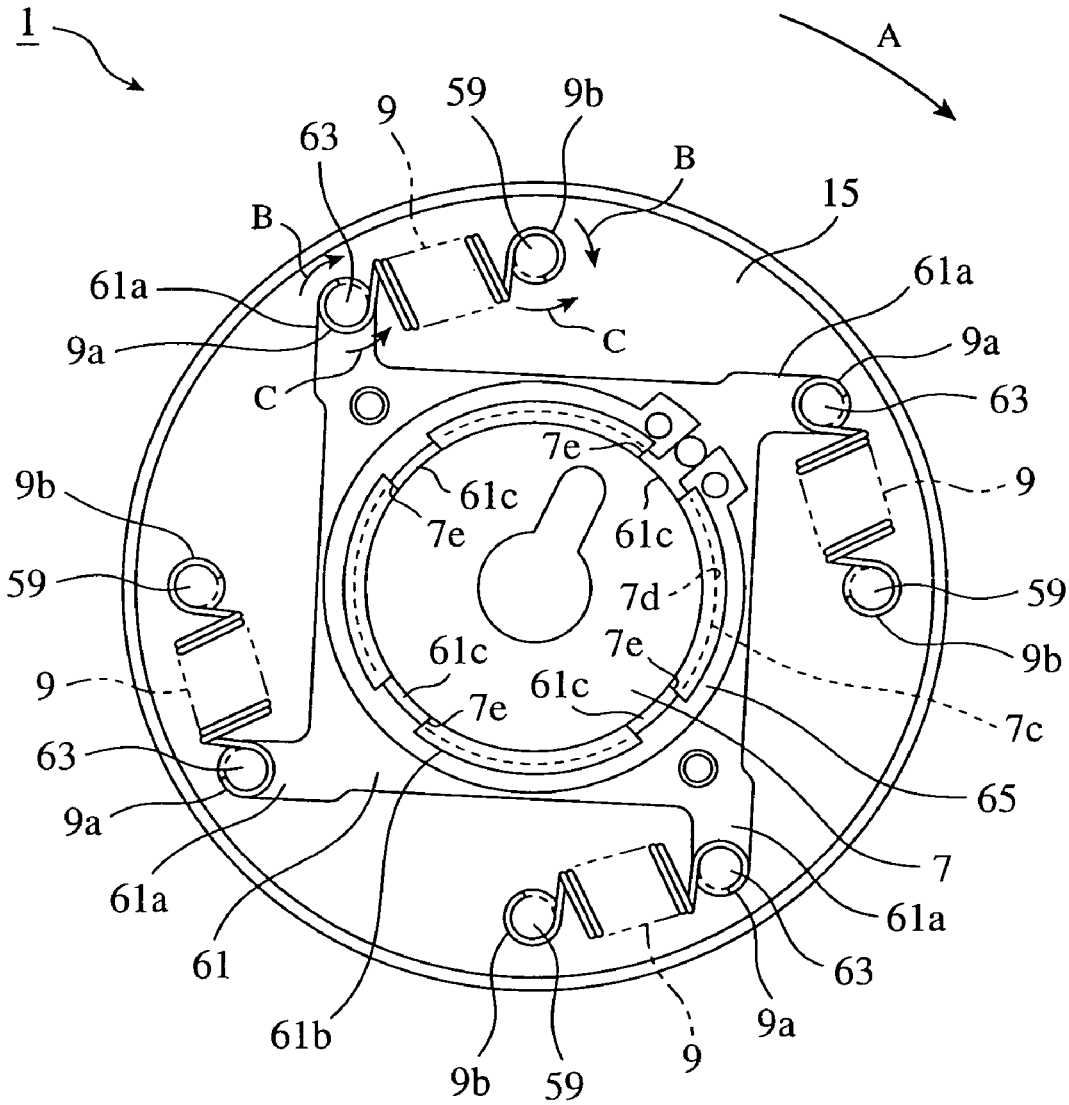
FIG. 13 is a front view, seen with a plate removed, showing the state where a second rotor is at the most advanced position with respect to a first rotor in the valve timing adjusting device shown in FIG. 11.
Figure 14:
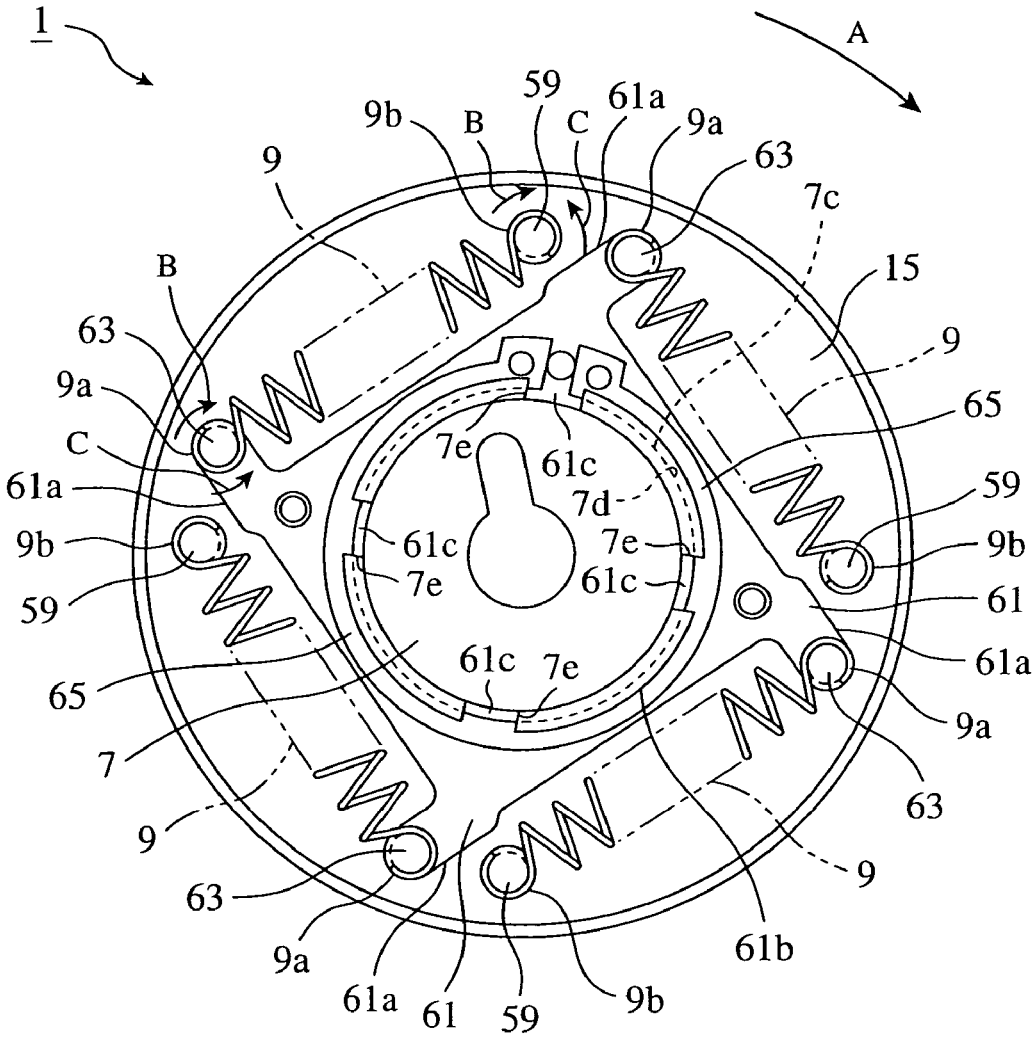
FIG. 14 is a front view, seen with a plate removed, showing the state where the second rotor is at the most lagged position with respect to the first rotor in the valve timing adjusting device shown in FIG. 11.

FIG. 11 is an axial sectional view showing an internal structure of a valve timing adjusting device according to the forth embodiment of the present invention. FIG. 12 is a radial sectional view taken along the line XII—XII of FIG. 11. FIG. 13 is a front view, seen with a plate 69 removed, showing the state where a second rotor is as the most advanced position with respect to a first rotor in the valve timing adjusting device shown in FIG. 11. FIG. 14 is a front view, seen with a plate 69 removed, showing the state where the second rotor is at the most lagged position with respect to the first rotor in the valve timing adjusting device shown in FIG. 11. Of the constituent elements in the fourth embodiment, like reference numerals as in the first embodiment designate like constituent elements, and thus explanations thereof are omitted for brevity's sake.

A feature of the fourth embodiment is in that it is arranged that the tension spring 9 is provided at a place away from the oil-pressure chamber such as the lagged-side oil-pressure chamber 23, unlike the above mentioned arrangement in which the tension spring 9 is placed within the lagged-side oil-pressure chamber 23 in the first to third embodiments. On the external face of the cover (first rotor) 15 that covers the advanced-side oil-pressure chamber 21 and the lagged-side oil-pressure chamber 23, a plurality of pin fixing portions 15*a* (four pin fixing portions in the fourth embodiment) are provided circumferentially at equally spaced intervals. On each of the pin fixing portions 15*a*, a pin 59 is upwardly fixed. On the external peripheral face of each of the pins 59, as shown in FIG. 11, a concave 59*a* is formed circumferentially. In the concave 59*a*, the hook-shaped end 9*b* of the tension spring 9 is held therein through the engagement.

Moreover, outside the cover 15, a plate-shaped holder 61 having four corners 61*a* is provided. The holder 61 is a substantially rectangular plate member that has four corners 61*a* as shown in FIG. 13 and FIG. 14. In the center of the holder is formed a substantially cylindrical opening 61*b* having convexes 61*c*. As shown in FIG. 11, FIG. 13, and FIG. 14, on each of the corners 61*a* of the holder 61, a pin 63 is upwardly provided. On the external peripheral face of each of the pins 63, as shown in FIG. 11, a concave 63*a* is formed circumferentially. In the concave 63*a*, the hook-shaped end 9*a* of the tension spring 9 is held therein through the engagement.

Meanwhile, in the fourth embodiment, of both the end faces of the boss 7*a* in the vane rotor 7, on the end face of the opposite side from the housing 11 side is formed a substantially cylindrical peripheral wall 7*c* that axially projects. In the peripheral wall 7*c*, a concave 7*d* is formed along cut grooves (concaves) 7*e* circumferentially. In these cut grooves (concaves) 7*e*, the convexes 61*c* of the holder 61 are engaged to thereby restrict the rotational movement of the holder 61 with respect to the vane rotor 7. In addition, in the concave 7*d*, a retaining ring (fixing portions) 65 is engaged to restrict the axial movement of the holder 61 with respect to the vane rotor 7. This integrates the holder 61 with the vane rotor 7, and the holder 61 rotates synchronously with the vane rotor 7.

The holder 61, tension springs 9, and retaining ring 65 are covered by the plate 69 fastened on the holder 61 by a bolt 67. The plate 69 is a substantially doughnut-shaped member as shown in FIG. 11, and has a substantially "U" shaped cross-sectional configuration.

It should be appreciated that although in the fourth embodiment, unlike the first to second embodiments, it is arranged that the vane rotor 7 is provided with three vanes 7*b*, and the case 13 is provided with three shoes 13*a* as shown in FIG. 12, it may be provided two, or four or more vanes 7*b* and shoes 13*a* without being limited to this arrangement. While in the end of each of the vanes 7*b* (outermost periphery) is provided a seal means for blocking a flow of oil between the advanced-side oil-pressure chamber 21 and the lagged-side oil-pressure chamber 23, a clearance between the end of the vane and the case 13 may be narrowed to an infinitesimal degree to block a flow of oil. Meanwhile, while in the outermost periphery of each of the shoes 13*a* of the case 13, a clearance between the shoe and the vane rotor 7 is reduced to a minute degree to block a flow of oil. Instead, the flow of oil may be blocked by providing a seal means therebetween.

The operation of the fourth embodiment will now be described below.

In the unlocking state, as shown in FIG. 13, to move a relative position of the second rotor 7 with respect to the first rotor 3 to the advanced side or the most advanced position, it has only to rotate the second rotor 7 in the direction indicated by the arrow A by the advanced-side oil pressure and an urging force (return force to the stationary state) of the tension spring 9 serving as the assisting spring in addition to the oil pressure. At that time, the hook-shaped ends 9*a* and 9*b* of the tension spring 9 are rotated in the direction indicated by the arrow B together with the pin 59 on the first rotor side and the pin 63 on the second rotor side, respectively and are outwardly forwarded in such a condition that they are wound around the external surfaces of the respective pins. For this reason, the tension spring 9 is immune to the occurrence of bending at the time of contraction, and the spring is maintained in a straight line.

Similarly, in the unlocking state, as shown in FIG. 14, to move a relative position of the second rotor 7 with respect to the first rotor 3 to the lagged side or the most lagged position, it has only to rotate the second rotor 7 in the opposite direction relative to the direction indicated by the arrow A by the lagged-side oil pressure against an urging force (return force to the stationary state) of the tension spring 9. At that time, the hook-shaped ends 9*a* and 9*b* of the tension spring 9 are rotated in the direction indicated by the arrow C (in the opposite direction relative to the direction indicated by the arrow B) together with the pin 45 on the vane side and the pin 49 on the shoe side, respectively and are unwound from the external surfaces of the respective pins. Therefore, the tension spring 9 is expanded uniformly in any part at the time of expansion, thereby securely maintaining the spring in a straight line without being slacked.

As mentioned above, through the structure according to the fourth embodiment in which it is arranged that the tension springs 9 are placed at the place away from the advanced-side oil-pressure chamber 21 or the lagged-side oil-pressure chamber 23, it simplifies an internal structure of the valve timing adjusting device 1, and facilitates a maintenance work of the tension spring 9 to that extent by the grace of the novel arrangement that each of the tension springs 9 is not placed within the advanced-side oil-pressure chamber 21 or the lagged-side oil-pressure chamber 23. According to the fourth embodiment, it readily secures the number of the vane 7*b* on the second rotor 7 side necessary to maintain an output torque of the engine (not shown), and the strength of the shoe 13*a* on the first rotor 3 side even when an operating angle (rotation angle) is set to a large value. Also, according to the fourth embodiment, it widely secures a space where the tension spring 9 can be placed. As a result, it lightens a load imposed on the tension spring 9, which wins the freedom of design flexibility.

Further, through the structure according to the fourth embodiment in which it is arranged that the tension spring 9 is disposed between the pin 59 provided on the first rotor 3 and the pin 63 provided on the holder 61, and that the holder 61 and the second rotor 7 are integrally connected with each other by the use of the convexes of the holder, the concaves of the rotor, and the retaining ring 65, it greatly improves assembly characteristics of the tension spring 9 to the valve timing adjusting device 1.

Moreover, through the structure according to the fourth embodiment in which it is arranged that the valve timing adjusting device have a plurality of tension springs 9, it allows a secure and quick relative rotation of the second rotor 7 with respect to the first rotor 3 by an urging force of the plurality of tension springs 9.

Furthermore, through the structure according to the fourth embodiment in which it is arranged that the plurality of tension springs 9 are arranged at equally angled intervals, it suppresses an inclination of the second rotor that has been integrally connected with the holder 61. This guarantees a smooth relative rotation between the first rotor 3 and the second rotor 7.

It should be appreciated that although in the fourth embodiment, the device includes the locking mechanism similar to the locking mechanism generally composed of the receiving hole 29, lock pin 31, and engaging hole 41 discussed in the first embodiment; and the unlocking mechanism resemblant to the unlocking mechanism generally composed of the unlocking oil passage 42, an illustration of the locking mechanism and unlocking mechanism is omitted in FIG. 12. Alternatively, the valve timing adjusting device may include a locking mechanism and an unlocking mechanism different from those in the first embodiment, respectively.

Additionally, while in the fourth embodiment the tension spring 9 is provided between the pin 59 fixed on the first rotor 3 side and the pin 63 fixed on the second rotor 7 side, the hook-shaped end 9*a* and 9*b* of the tension spring 9 may be fixed on a rotatable pin as shown in the second embodiment. In addition, while in the fourth embodiment, the tension spring 9 is provided between the pin 59 located on the first rotor 3 side and the pin 63 located on the second rotor 7 side, it may be arranged that a through hole (hole) is formed instead of the pin as shown in the third embodiment, and each of the hook-shaped ends 9*a* and 9*b* of the tension spring 9 rotatably held therein.

What is claimed is:

1. A valve timing adjusting device comprising:

a first rotor that rotates synchronously with a cranikshafl of an internal combustion engine;

a second rotor that is relatively rotatable by a predetermined angle within the first rotor, and is integrally secured on the end face of an intake camshaft or an exhaust camshaft of the internal combustion engine; and a tension spring that adjusts a relative position between the second rotor and the first rotor, wherein both ends of the tension spring are formed in the shape of a hook, and the both ends of which are rotatably maintained, respectively.

2. The valve timing adjusting device according to claim 1, wherein the hook-shaped ends of the tension spring are rotatably maintained around a pin provided on each of the first rotor and the second rotor.

3. The valve timing adjusting device according to claim 2, wherein the diameter of the hook-shaped ends of the tension spring are larger than that of the pin.

4. The valve timing adjusting device according to claim 1, wherein the hook-shaped ends of the tension spring are secured on a pin rotatably provided on each of the first rotor and the second rotor.

5. The valve timing adjusting device according to claim 1, wherein the hook-shaped ends of the tension spring are rotatably maintained in a hole formed in each of the first rotor and the second rotor.

6. The valve timing adjusting device according to claim 1, wherein a plurality of tension springs are provided in each of oil-pressure chambers partitioned between the first rotor and the second rotor.

7. The valve timing adjusting device according to claim 6, wherein a partition is provided between the plurality of tension springs.

8. The valve timing adjusting device according to claim 1, wherein the tension spring is provided in a place separated from oil-pressure chambers partitioned between the first rotor and the second rotor.

9. The valve timing adjusting device according to claim 8, wherein the tension spring is placed between a pin provided on the first rotor and that provided on a holder, and the holder and the second rotor are integrally combined through the engagement between a concave or a convex of the holder and the second rotor, and by means of a fixing member.

10. The valve timing adjusting device according to claim 8, wherein a plurality of tension springs are provided.

11. The valve timing adjusting device according to claim 10, wherein the plurality of tension springs are placed at equally spaced intervals.

* * * * *

UNITED STATES PATENT AND TRADEMARK OFFICE

CERTIFICATE OF CORRECTION

PATENT NO. : 7,146,946 B2
APPLICATION NO. : 10/992775
DATED : December 12, 2006
INVENTOR(S) : Koji Yudate et al.

It is certified that error appears in the above-identified patent and that said Letters Patent is hereby corrected as shown below:

On Title Page Item (73) Assignee:
Please correct the word "Mitsubishiki Denki Kabushiki Kaisha" to --Mitsubishi Denki Kabushiki Kaisha--.

Signed and Sealed this

Second Day of October, 2007

JON W. DUDAS
*Director of the United States Patent and Trademark Office*